US005887735A

United States Patent [19]

Abel

[11] Patent Number: 5,887,735

[45] Date of Patent: Mar. 30, 1999

[54] CRANE VEHICLE WITH AN OVERLOAD SAFETY UNIT

[75] Inventor: Peter Abel, Mengen, Germany

[73] Assignee: Liebherr-Werk Ehingen GmbH, Ehingen/Donau, Germany

[21] Appl. No.: 939,188

[22] Filed: Sep. 29, 1997

Related U.S. Application Data

[63] Continuation of Ser. No. 767,387, Dec. 16, 1996, abandoned.

[30] Foreign Application Priority Data

Dec. 15, 1995 [DE] Germany ..... 29519928

[51] Int. Cl.[6] ..... B66C 13/18

[52] U.S. Cl. ..... 212/277

[58] Field of Search ..... 212/277, 276, 212/270, 301, 302

[56] References Cited

U.S. PATENT DOCUMENTS 5,160,056 11/1992 Yoshimatsu et al. ..... 212/277
5,217,126 6/1993 Hayashi et al. ..... 212/277

FOREIGN PATENT DOCUMENTS 0539207 4/1993 European Pat. Off. .
3420596 12/1985 Germany .
3605462 8/1987 Germany .
1440614 6/1976 United Kingdom ..... 212/277

*Primary Examiner*—Thomas J. Brahan
*Attorney, Agent, or Firm*—Dilworth & Barrese

[57] ABSTRACT

The present invention relates to a crane vehicle with an overload safety unit, with a jib, preferably a telescoping jib, hinged to its superstructure which jib can be luffed by means of a luffing ram which is hinged to the jib and the superstructure, with extending sliding beams which are positioned at the end parts of the longitudinal sides of the carrier which face each other and which are provided at their ends with extending stabilizer bases, and with a unit measuring the swing angle of the jib the signals of which unit are fed to a processing unit of the overload safety unit, where the overload safety unit generates a warning signal and/or stops the crane operation when the crane reaches or exceeds limits which endanger its stability. In accordance with the invention a monitoring unit which detects the extension state or extension length of the sliding beams is provided which feeds the signals corresponding to the corresponding extension length of the individual sliding beams to the overload safety unit and the processing unit of the overload safety unit determines the stability of the stand rectangle resulting from the extension state of the sliding beams for every angle of swing of the jib from the signals of the monitoring unit for the extension length of the sliding beams and from the signals from the unit which measures the angle of swing of the jib.

20 Claims, 2 Drawing Sheets

CRANE VEHICLE WITH AN OVERLOAD SAFETY UNIT

This is a continuation, of application Ser. No. 08/767,387 filed on Dec. 16, 1996, now abandoned.

BACKGROUND OF THE INVENTION

The present invention relates to a crane vehicle with an overload safety unit, with a jib, preferably a telescoping jib, hinged to its superstructure which jib can be luffed by means of a luffing ram which is hinged to the jib and the superstructure, with extending sliding beams which are positioned at the end parts of the longitudinal sides of the carrier which face each other and which are provided at their ends with extending stabilizer bases, and with a unit measuring the swing angle of the jib the signals of which unit are fed to a processing unit of the overload safety unit, where the overload safety unit generates a warning signal and/or stops the crane operation when the crane reaches or exceeds limits which endanger its stability.

The stability of a crane vehicle with telescoping jib depends in addition to the size of the load hanging from the telescoping jib among other things on the luffing angle, the extension length of the telescoping jib, on the sag of the telescoping jib and in particular also on the angle of rotation of the superstructure with the telescoping jib relative to the carrier and on the stand rectangle defined by the stabilizer bases of the sliding beams. With regard to the stand rectangle defined by the extended sliding beams and stabilizer bases the stability of the crane is greatest when the jib points in the direction of the sliding beam extended the furthest. When the sliding beams are retracted and the stabilizer bases extended the stability is greater in the longitudinal direction of the carrier than in the direction of its transverse axis. The overload protection must therefore always take into account the extension state of the sliding beams, which is difficult to the extent that the stability also changes with different extension lengths of individual sliding beams.

SUMMARY OF THE INVENTION

It is therefore the object of the present invention to provide a crane vehicle of the type described above in which the overload safety unit takes into account the different extension lengths of the sliding beams in a reliable manner.

In accordance with the invention this object is solved for a crane vehicle of the type described above by providing a monitoring unit which detects the extension state or extension length of the sliding beams and which feeds the signals corresponding to the relevant extension length of the individual sliding beams to the overload safety unit and by the processing unit of the overload safety unit determining the stability of the stand rectangle resulting from the extension state of the sliding beams for every angle of swing of the jib from the signals of the monitoring unit for the extension length of the sliding beams and from the signals from the unit measuring the angle of swing of the jib. The signals generated by the swing angle measuring unit and the monitoring unit of the sliding beams in accordance with the angle of swing or the extension lengths of the sliding beams are processed by the processing unit which comprises a microcomputer by comparing them with the other values determining the stability, with the overload safety unit generating a signal which stops the crane operation when the crane reaches or exceeds limits which endanger its stability.

To be able to reduce the computing operation of the processing unit, a preferred embodiment of the invention provides that the 360° angle of swing of the jib is divided into several swing angle sections and that for each of these swing angle sections with a jib positioned in this area the stability values resulting from the extension lengths of the sliding beams are filed in a table (bit-map) from which the processing unit reads the current stability values of the stand rectangle corresponding to the measured extension lengths of the sliding beams.

It can be provided for a crane vehicle in accordance with the invention that each sliding beam possesses only three stabilizing positions in which it is bolted in each case, namely first a retracted position in which the stabilizer base is positioned in the area of the longitudinal side of the carrier, a middle position and a fully extended position. If only these three stabilizing positions are taken into account for the calculation of the stability of each of the four sliding beams, the safety values for each of the areas can be filed in a clearly arranged table.

The calculating work of the processing unit can be reduced even further by dividing the 360° angle of swing of the jib into four quadrants to determine the stability values of the stand rectangle. For each of these four quadrants the stability values for all potential extension lengths of the sliding beams are filed in such a manner that for the whole quadrant the smallest values applying to it are valid.

A particularly preferred embodiment of the invention provides that from the measured values of the angle of swing of the jib and the extension lengths of the sliding beams those angle sections in the safety sector are determined in which the jib can be swivelled at a given load up to a defined smallest luffing angle of the jib. In accordance with this embodiment variable angle sections are therefore determined in which the jib with the relevant load hanging from it can be swivelled without risk. Here, the smallest luffing angle which is permissible in this angle section is assumed for each of these angle sections. This definition of variable angle sections also provides a simplification of the computation, as the permissible safety values do not have to be taken into account for each angle position of the jib.

Appropriately, for each extension state of the sliding beams four angle sections are determined the boundaries of which are appropriately formed by lines drawn from the swivel axis of the jib to the ends of the sliding beams bearing the stabilizer bases.

When, during swivelling, the jib approaches the boundary of an angle section which borders an angle section with a lower permissible load, the stop signal is given.

The reduction of the angle sections has the advantage that in larger angle sections the crane operator need not fear that he might reach an angle boundary where the overload safety unit would react. However, the selection of larger angle sections means that the higher loads actually permissible in the sections, for example by swivelling the jib at smaller luffing angles, cannot be utilized.

BRIEF DESCRIPTION OF THE DRAWINGS

One embodiment of the invention is described in more detail by means of the following drawing in which.

DESCRIPTION OF THE PREFERRED EMBODIMENTS

Figure 1:
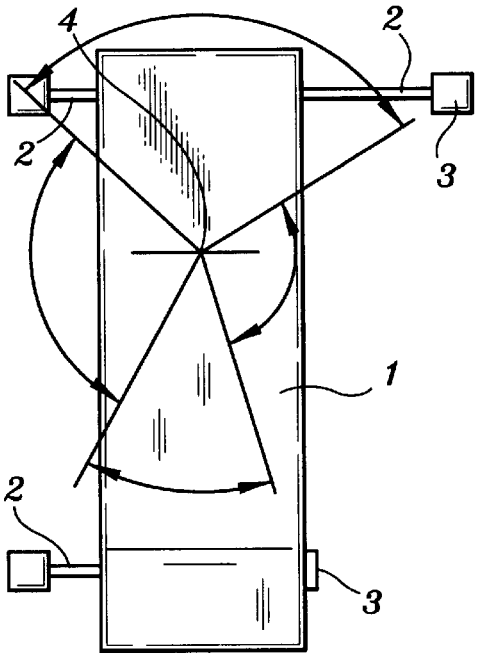
FIG. 1 shows a top view of the carrier of a crane vehicle with differently extended sliding beams in a schematic representation, FIG. 2 a top view according to FIG. 1 of a carrier with retracted sliding beams, and FIG. 3 a top view according to FIG. 1 of a carrier where the sliding beams on the righthand side are extended and the sliding beams on the lefthand side are retracted.

FIG. 1 shows a schematic view of a carrier 1 of a crane vehicle from which the sliding beams 2 are extended differently and which bear stabilizer bases 3 at their ends which can be extended at right angles to the sliding beams in a vertical direction towards the ground by means of hydraulic cylinders. Threaded spindles can also be provided to extend the stabilizer bases. The sliding beams 2 are positioned at the end parts of the two longitudinal sides of the carrier 1 and can be extended at right angles to its longitudinal middle plane.

In the embodiment shown the sliding beams can be extended in three stages in each of which they must be bolted in their guideways. These stages correspond to a retracted position in which the stabilizing lengths of the sliding beams are shortest a middle position and an extended position in which the stabilizing length is longest.

In the embodiment according to FIG. 1 the two sliding beams 2 of the lefthand side are in their middle position, the upper sliding beam of the righthand side in its most extended position and the sliding beam at the right bottom in its retracted position. This extension pattern of the sliding beams and the stabilizing lengths resulting from these beams produce a stand rectangle which can absorb luffing forces of different magnitudes via the swing angle of the jib.

In the stand rectangle four angle sections have been defined which result from lines drawn from the swivel axis 4 of the jib to the ends of the sliding beams 2 or to the stabilizing lines of the stabilizing bases 3. For each of these angle sections certain permissible jib moments have been determined whose different magnitudes are indicated by the radius of the circular arcs spanning the angle sections. For each angle section a uniform permissible jib moment is defined here to simplify matters which corresponds to the largest permissible jib moment for this angle section.

The different four angle sections resulting from the different extension lengths of the sliding beams and the largest jib moments permissible for each of these angle sections are filed in a lifting capacity table from which these values can be read by the overload safety unit for processing in the processing unit.

Figure 2:
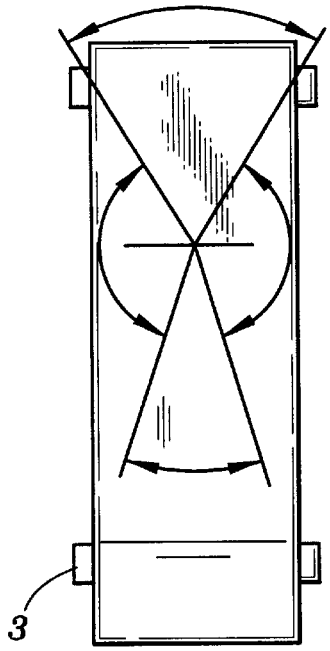

In FIG. 2 the state of the sliding beams can be seen which results after their retraction. It can be concluded from FIG. 2 that the stability in the cross direction of the carrier is much smaller than in its longitudinal direction where the stability is just as large as when the sliding beams are extended, however only across a smaller angle section.

Figure 3:
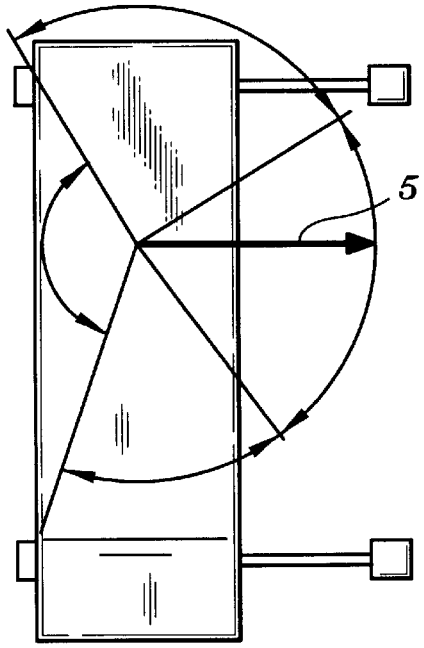
Figure 4:
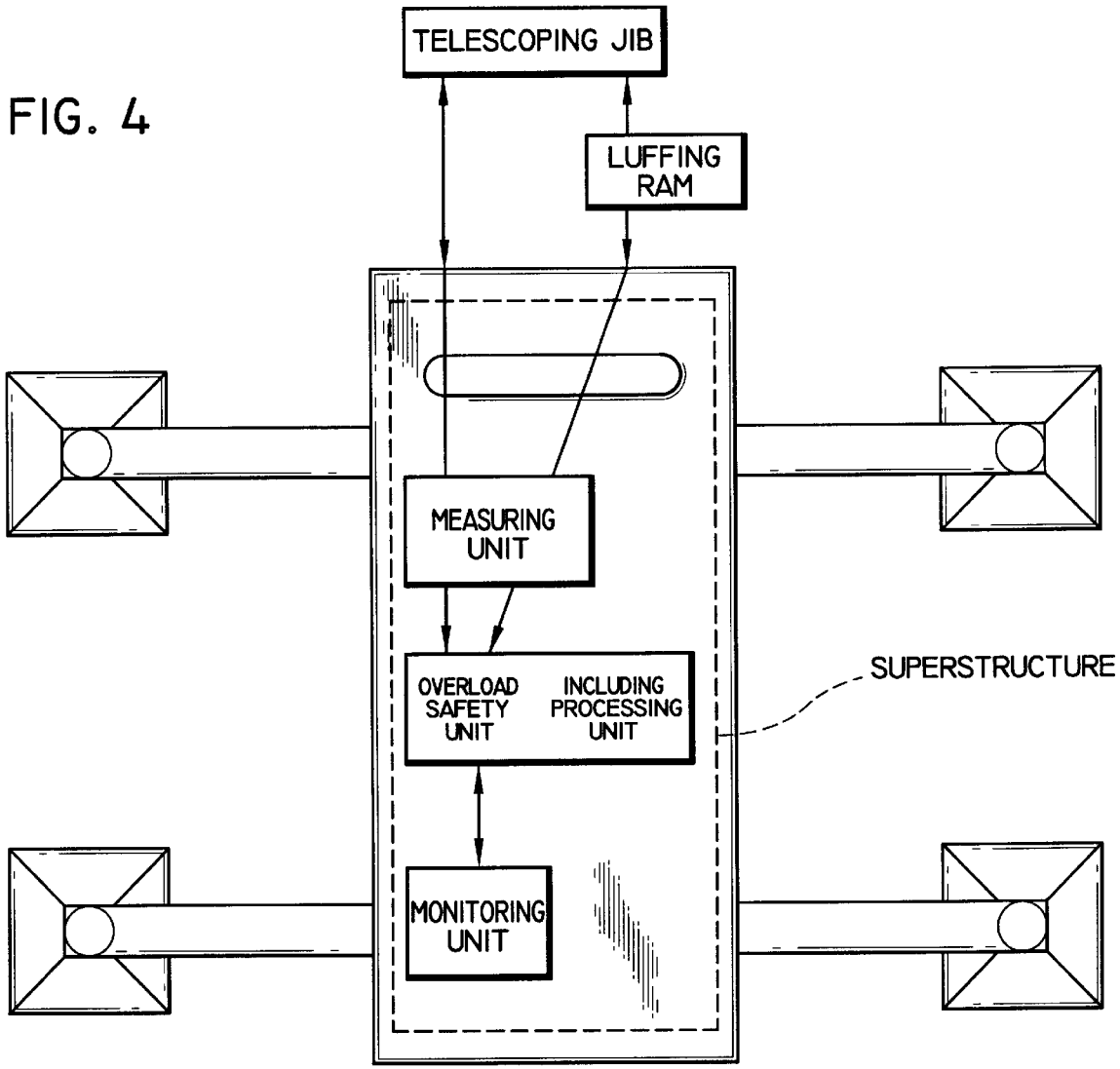
FIG. 4 is a schematic view illustrating the crane features.

FIG. 3 shows the state in which the sliding beams of the righthand side are fully extended and those of the lefthand side are retracted. This results in a relatively large angle section in which the jib designated by arrow 5 can be swivelled without obstacles with a large permissible overturning moment

I claim:

1. A crane vehicle provided with an overload safety unit and a jib, hinged to a superstructure thereof, which jib can be luffed by means of a luffing ram which is hinged to the jib and the superstructure, extending sliding beams which are positioned at end parts of longitudinal sides of the carrier which face each other and which are provided at ends thereof with extending stabilizer bases, and a unit measuring swing angle of the jib, the signals of which unit are fed to a processing unit of the overload safety unit, the overload safety unit takes at least one of the following actions (i) and (ii):

(i) generating a warning signal, and (ii) stopping crane operation, when the crane reaches or exceeds limits which endanger its stability, wherein a monitoring unit which detects the extension state or extension length of the sliding beams is provided which feeds signals corresponding to the extension of length of the individual sliding beams to the overload safety unit, the processing unit of the overload safety unit determines the stability of a stand rectangle resulting from the extension state of the sliding beams for every angle of swing of the jib, from the signals of the monitoring unit for the extension lengths of the sliding beams and from the signals from the unit which measures the angle of swing of the jib, and the 360° angle of swing of the jib is divided into four quadrants and for each of these swing angle quadrants, with the jib positioned in this area, a stability value resulting from the extension lengths of the sliding beams are filed in a table (bit-map) from which the processing unit reads the current stability values of the stand rectangle corresponding to the measured extension lengths of the sliding beams such that said overload safety unit is structured and arranged to establish a constant loading threshold for the extension state or length of the sliding beams in each quadrant.

2. A crane vehicle according to claim 1, wherein from the measured values of the angle of swing of the jib and the extension lengths of the sliding beams, angle sections in a safety sector are determined in which the jib can be swivelled at a given load up to a defined smallest luffing angle of the jib.

3. A crane vehicle according to claim 2, wherein four angle sections are formed for each extension state of the sliding beams, the boundaries of which angle sections consist of lines drawn from a swivel axis of the jib to the ends of the sliding beams bearing the stabilizer bases.

4. A crane vehicle according to claim 1, wherein the jib is a telescoping jib.

5. A crane vehicle according to claim 1, wherein from the measured values of the angle of swing of the jib and the extension lengths of the sliding beams, angle sections in a safety sector are determined in which the jib can be swivelled at a given load with largest permissible moment.

6. A crane vehicle according to claim 1, comprising four sliding beams.

7. A crane vehicle according to claim 1, comprising threaded spindles arranged to extend the stabilizer bases from the respective beams.

8. A crane vehicle according to claim 1, wherein the sliding beams are each arranged to be extended in stages and locked in place in each said stage, with the overload safety unit structured and arranged to establish the constant loading threshold for each stage of outrigger extension.

9. A crane vehicle according to claim 8, wherein the constant loading threshold is established as a smallest permissible luffing angle of the jib or largest permissible jib moment.

10. The crane vehicle according to claim 1, wherein the constant loading threshold is established as a smallest permissible luffing angle of the jib or largest permissible jib moment.

11. A crane vehicle provided with an overload safety unit and a jib, hinged to a superstructure thereof, which jib can be luffed by means of a luffing ram which is hinged to the jib and the superstructure, extending sliding beams which are positioned at end parts of longitudinal sides of the carrier which face each other and which are provided at ends thereof with extending stabilizer bases, and a unit measuring swing angle of the jib, the signals of which unit are fed to a processing unit of the overload safety unit, the overload safety unit takes at least one of the following actions (i) and (ii):

(i) generating a warning signal, and (ii) stopping crane operation, when the crane reaches or exceeds limits which endanger its stability, wherein a monitoring unit which detects the extension state or extension length of the sliding beams is provided which feeds signals corresponding to the extension of length of the individual sliding beams to the overload safety unit, the processing unit of the overload safety unit determines the stability of a stand rectangle resulting from the extension state of the sliding beams for every angle of swing of the jib, from the signals of the monitoring unit for the extension lengths of the sliding beams and from the signals from the unit which measures the angle of swing of the jib, the 360° angle of swing of the jib is divided into four quadrants, and the sliding beams are each arranged to be extended in stages, in each stage of which the beams are arranged to be locked in place to secure the same in the respective stage such that said overload safety unit is structured and arranged to establish a constant loading threshold for each stage of outrigger extension in each said quadrant.

12. A crane vehicle according to claim 11, wherein the sliding beams are each arranged to be extended to at least three stages.

13. A crane vehicle according to claim 12, when the stages respectively correspond to a retracted position in which stabilizing lengths of the beams are shortest, a middle position and a fully extended portion in which the stabilizing length is largest.

14. A crane vehicle according to claim 11, wherein the constant loading threshold is established as a smallest permissible luffing angle of the jib or largest permissible jib moment.

15. A crane vehicle according to claim 11, comprising four sliding beams.

16. A crane vehicle according to claim 15, wherein the sliding beams are each arranged to be extended to at least three stages.

17. Method for detecting extension state of extendable sliding beams provided in a crane vehicle for supporting the same and positioned at ends of longitudinal sides of the vehicle facing each other, with extending stabilizer bases being provided at respective ends of the sliding beams and a jib rotably mounted upon the crane, comprising the steps of detecting extension state of all sliding beams, feeding signals corresponding to the extension length of the individual sliding beams to an overload safety unit, measuring swing angle of the jib, determining stability of a stand rectangle resulting from the extension states of the sliding beams for every angle of swing of the jib rotably mounted upon the crane and for the measured swing angle of the jib, generating a warning signal or stopping crane operation or a combination thereof when the crane reaches or exceeds limits endangering stability based upon the determined stability, dividing the 360° angle swing of the jib into four quadrants, and establishing a constant loading threshold for the extension state or length of the sliding beams in each said quadrant.

18. The method of claim 17, comprising the additional steps of defining said fine quadrants as four angle sections of the stand rectangle resulting from lines drawn from a swivel axis of the jib to the ends of the sliding beams bearing the stabilizing bases, determine permissible jib moments for each of the angle sections, the moments having different magnitudes indicated by a radius of a circular arc spanning the respective angle sections, and defining a uniform permissible jib moment corresponding to a largest permissible jib moment for each angle section.

19. The method of claim 17, comprising the additional steps of extending the sliding beams to at least three separate stages, and establishing the constant loading threshold for each stage of outrigger extension.

20. The method of claim 17, comprising the additional step of determining the constant loading threshold as a smallest permissible luffing angle of the jib or largest permissible jib moment.

* * * * *